US008025324B2

(12) United States Patent
Hellgren

(10) Patent No.: US 8,025,324 B2
(45) Date of Patent: Sep. 27, 2011

(54) FLIPPER ARM DRIVE

(75) Inventor: Anders Hellgren, Järfälla (SE)

(73) Assignee: Bromma Conquip AB (SE)

( * ) Notice: Subject to any disclaimer, the term of this patent is extended or adjusted under 35 U.S.C. 154(b) by 411 days.

(21) Appl. No.: 12/161,460

(22) PCT Filed: Jan. 15, 2007

(86) PCT No.: PCT/SE2007/000026

§ 371 (c)(1),
(2), (4) Date: Jan. 13, 2009

(87) PCT Pub. No.: WO2007/084052

PCT Pub. Date: Jul. 26, 2007

(65) Prior Publication Data

US 2009/0200814 A1 Aug. 13, 2009

(30) Foreign Application Priority Data

Jan. 18, 2006 (SE) ..... 0600092

(51) Int. Cl.
*B66C 1/00* (2006.01)

(52) U.S. Cl. ..... 294/81.1

(58) Field of Classification Search ..... 294/81.1, 294/81.51, 81.53, 81.61, 68.3
See application file for complete search history.

(56) References Cited

U.S. PATENT DOCUMENTS

| | | | | |
|---|---|---|---|---|
| 3,042,227 | A | 7/1962 | Tantlinger | |
| 3,078,115 | A | 2/1963 | Harlander et al. | |
| 3,885,676 | A | 5/1975 | Wilson et al. | |
| 4,360,110 | A * | 11/1982 | Sigman et al. | 212/318 |
| 4,563,031 | A * | 1/1986 | Kishimoto et al. | 294/81.21 |
| 4,573,862 | A * | 3/1986 | Anderson | 198/750.11 |
| 4,592,692 | A * | 6/1986 | Suizu et al. | 414/792.8 |
| 4,621,852 | A * | 11/1986 | Maki | 294/86.4 |
| 5,971,456 | A * | 10/1999 | van Capelleveen | 294/88 |
| 6,598,916 | B2 * | 7/2003 | Miyazawa | 294/81.21 |

FOREIGN PATENT DOCUMENTS

| | | | |
|---|---|---|---|
| DE | 10140449 | A1 | 3/2003 |
| JP | 6255978 | A | 12/1994 |

* cited by examiner

*Primary Examiner* — Saul Rodriguez
*Assistant Examiner* — Stephen Vu
(74) *Attorney, Agent, or Firm* — Pepper Hamilton LLP

(57) ABSTRACT

The present invention relates to an arrangement on a spreader for lifting containers, the arrangement comprising a flipper arm which is supported at the corner of the spreader such that the flipper arm is pivotable between an upraised rest position and a lowered operative position wherein the flipper arm is effective for positioning of the spreader corner relative to the corresponding corner of a container upon connecting the spreader to the container. The arrangement is characterized in that the flipper arm is carried on a rotatable shaft and driven by a motor, and wherein a power transmission is inserted between the motor and the flipper arm, the power transmission being effective for the transfer of torque from the motor to the flipper arm upon energizing the motor, and operative for locking the flipper arm in its pivoted position upon non-energizing the motor.

4 Claims, 2 Drawing Sheets

Fig. 2
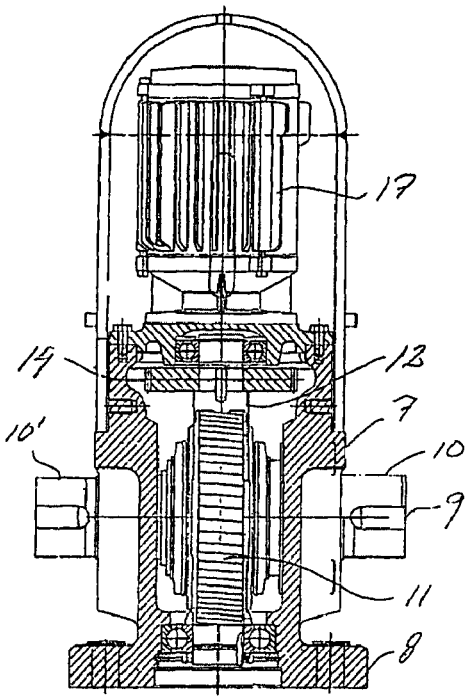
Fig. 3
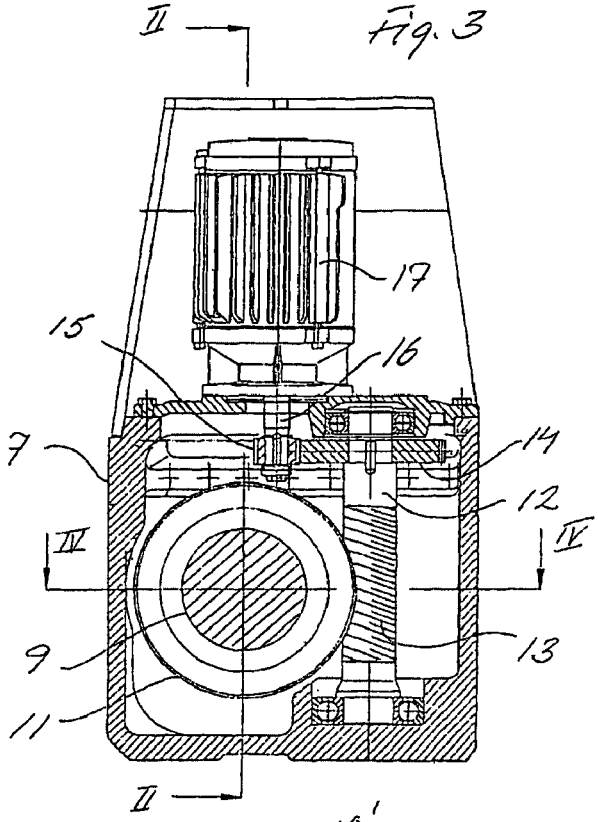
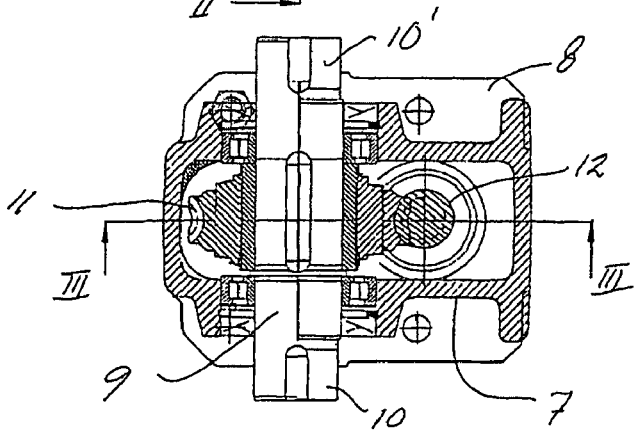
Fig. 4

FLIPPER ARM DRIVE

CROSS-REFERENCE TO RELATED APPLICATIONS

This application claims the priority benefit of PCT/SE2007/000026 filed Jan. 15, 2007, which claims priority to Sweden Patent Application No. 0600092-1, filed Jan. 18, 2006, the entireties of which are hereby incorporated by reference.

TECHNICAL FIELD OF THE INVENTION

The invention relates to an arrangement on a spreader which is operative for lifting containers, the arrangement comprising a flipper arm which is supported at the corner of the spreader such that the flipper arm is pivotable between an upraised rest position and a lowered operative position wherein the flipper arm is effective for positioning of the spreader corner relative to the corresponding corner of a container upon connecting the spreader to the container.

BACKGROUND AND PRIOR ART

Flipper arm is the technical term used in the subject trade as a definition for the arms that are pivotally arranged in the corners of a spreader. The flippers arms are controllable in a downwards pivoted motion so as to extend below the spreader and in the lowered position effective for guiding the spreader upon lowering towards the top side of the container, in the connection of the spreader to the container's corner fittings through connecting means fitted to the spreader. Such flipper arms are typically associated with piston/cylinder units that are supplied from a hydraulic power system that is continuously pressurized for powering the movements of the flipper arm, as well as for holding the flipper arm in position.

A typical feature in the operation of the flipper arm is that the power needed for pivoting the flipper arm between the raised rest position and the lowered operative position may be seen as moderate, whereas the external loads on the flipper arm applied from contact with the container during positioning may be considerable, and many times the size of the power that is required for pivoting the flipper arm. For reason of security, and in order to withstand such external forces that tend to move the flipper arm away from its operative position, the flipper arm's hydraulic drive means is often oversized.

SUMMARY OF THE INVENTION

The present invention aims to provide a flipper arm drive that it designed to protect the powering system against loads resulting from the flipper arm's contact with the container and from lateral movements of the spreader relative to a container in connecting operations.

This object is met through the arrangement defined in accompanying claims.

Briefly, through the present invention there is provided an arrangement on a spreader comprising a flipper arm which is supported at the corner of the spreader such that the flipper arm is pivotable between an upraised rest position and a lowered operative position wherein the flipper arm is effective for positioning of the spreader corner relative to the corresponding corner of a container upon connecting the spreader to the container. The arrangement is characterized in that the flipper arm is carried on a rotatable shaft and driven by a motor, and wherein a power transmission is inserted between the motor and the flipper arm, the power transmission being effective for the transfer of torque from the motor to the flipper arm upon energizing the motor, and operative for locking the flipper arm in its pivoted position upon de-energizing the motor.

In the preferred embodiment, the power transmission between the motor and the flipper arm comprises a self-locking worm drive including a worm screw driven by the motor and tangentially engaged by a gear-wheel carried on the rotatable shaft, wherein the pitch of threads are chosen to permit the gear-wheel to be rotated by the worm screw while preventing the worm screw from being rotated by the gear-wheel.

In addition, a parking brake may be included between the motor and the flipper arm and arranged to be de-activated upon energizing the motor, and activated upon de-energizing the motor.

Through the measures mentioned above there is provided, between the motor and the flipper arm, a power transmission which permits the use of electrical motors for powering the flipper arm's pivot motion between the rest and operative positions, respectively.

Further advantageous features and embodiments are defined in the subordinated claims.

SHORT DESCRIPTION OF THE DRAWINGS

The invention is further explained below with reference to the accompanying, diagrammatic drawings, wherein FIG. 1 is an end view showing a spreader in positioning operation for connecting to a container;

FIG. 2 is a vertical cross sectional view through a flipper arm drive according to the invention;

FIG. 3 is a corresponding cross sectional view, however twisted through 90°, and FIG. 4 is horizontal cross sectional view through the flipper arm drive.

DETAILED DESCRIPTION OF THE INVENTION

Figure 1:
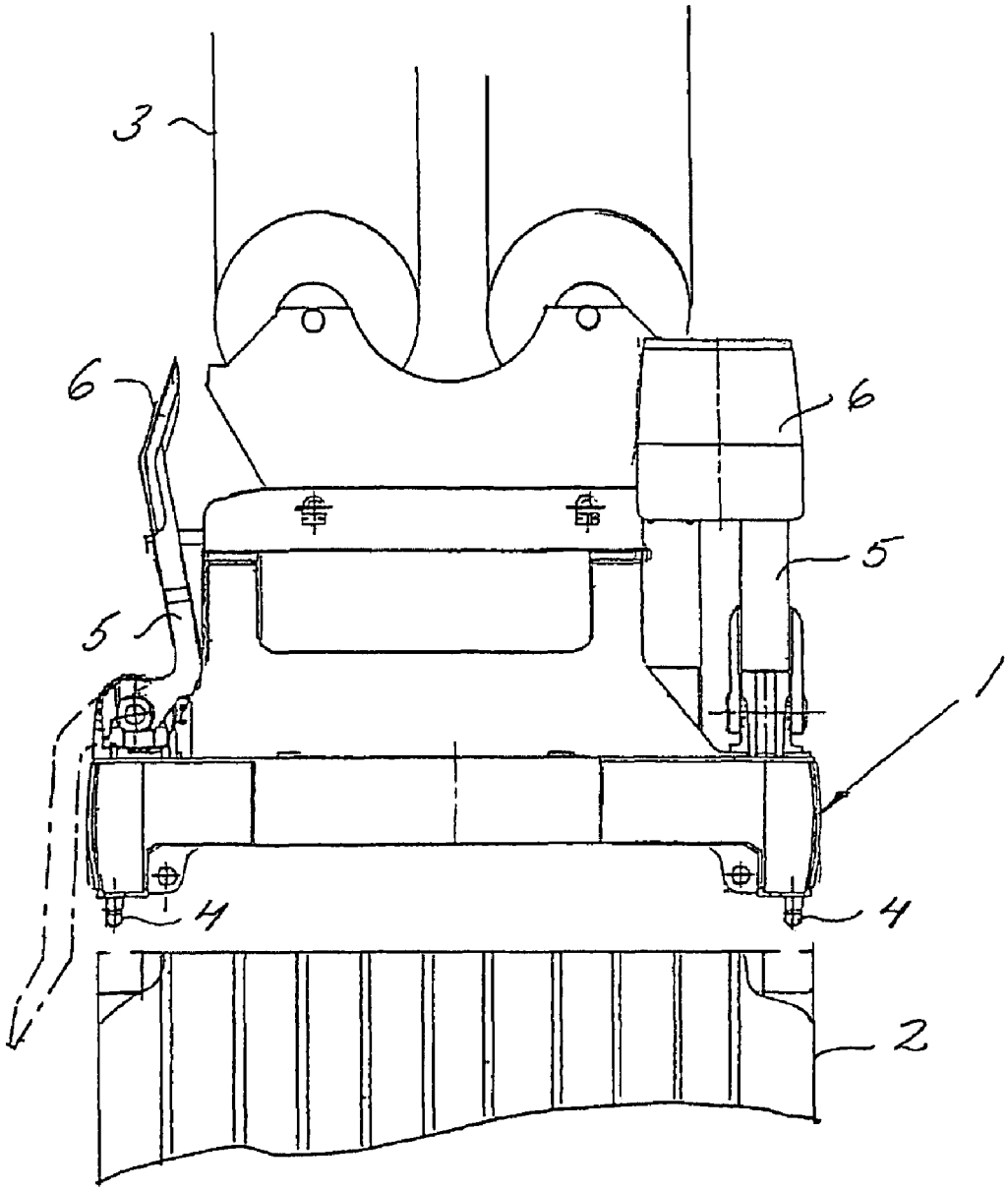

In FIG. 1, a container lifting spreader 1 is illustrated in positioning operation for connection to a container 2. The spreader 1 may be suspended in lines 3 from a crane, as illustrated in the example, or may be carried in a straddle carrier. Connection means 4 are mounted in the lower side of the spreader and designed to engage correspondingly shaped corner fittings in the corners of the container. A successful connection operation requisites an accuracy in the order of 25-50 mm as seen in radial directions from a centre of each corner fitting, when positioning the spreader.

For guidance of the spreader during connection operation, arms or flipper arms 5 are pivotally arranged in the spreader corners. A flipper arm 5 is pivotable between an upraised rest position and a lowered operative position, wherein the flipper arm extends below the spreader and adjacent a side of the container in order to position and guide the spreader upon lowering towards a top side of the container (the lowered position of a flipper arm 5 is illustrated through a dash-dotted line in FIG. 1). Typically, flipper arms 5 are arranged for guidance of the spreader in both longitudinal and transverse directions with respect to the container. In their free ends, the flipper arms 5 carry an angular guide plate 6, respectively, the guide plates sliding against the upper edge of the container to urge, when necessary, the spreader into alignment with the container during the lowering motion. In this connection, considerable lateral forces may arise that tend to pivot the flipper arm about its axis of rotation. According to the present invention a flipper arm drive is arranged in a way that these forces are prevented from acting upon the flipper arm's power supply system.

With reference to FIGS. 2-4, an embodiment of the invention is shown in cross sectional views, and mounted in a housing 7 that has a base plate 8 arranged for mounting the housing onto a spreader. A shaft 9, which is journalled for rotation in the housing, is arranged for supporting a flipper arm in the end 10 and/or 10' of the shaft, which end projects out from the housing. In the housing, a gear-wheel 11 is supported on the shaft 9 in concentric relation through a coupling that connects the gear-wheel in non-rotational relation to the shaft. A worm screw 12, which is journalled for rotation in the housing base and housing top, respectively, engages tangentially the gear-wheel 11 trough an external thread 13. In the upper end thereof, the worm screw 12 carries a gear-wheel 14 in non-rotational relation, the gear-wheel 14 engaging a drive wheel 15 that is supported on the power shaft 16 of a motor 17 which is mounted on the housing exterior. The drive wheel 15, the gearwheel 14, the worm screw 12 and the gear-wheel 11 together form a power transmission that transfers the motor's rotation and torque to the flipper arm, whereby the rotational speed of the motor may be changed down and adjusted to supply an output rotational speed that is suitable for the flipper arm. The diameters of the rotational elements of the illustrated embodiment results in a gear ratio of approximately 150:1, which is mentioned here only to provide a complete explanation of this example. In the described embodiment, the arrangement forms a unit which is mountable onto the spreader and which comprises the motor, and the power transmission with shaft for mounting of a flipper arm. The illustrated embodiment is advantageously mounted diagonally at the spreader corner such that a flipper arm, carried by the unit, is pivotable in a vertical plane that is diagonal relative to the spreader's corner.

The motor may be a hydraulic motor. However, the motor advantageously is an electric motor which is preferred for environmental reasons and with respect to maintenance. In both alternatives, the power transmission between the motor and the flipper arm is arranged in such way that the motor is dimensioned merely to provide the power that is required for pivoting the unloaded flipper arm by rotation of the shaft 9. More precisely, the power transmission is arranged to absorb any external load applied to the flipper arm, and to prevent such loads from being transferred back to the motor. In other words, the motor 17 is effective for rotation of the flipper arm only but non-effective for holding the flipper arm in its pivoted position, whether the flipper arm is lowered to its operative position or raised to its rest position. This means, in the case of an electromotor, that the power supply may be shut off when the flipper arm has reached its position, and in the case of a hydraulic motor it means that hydraulic pressure is not required for holding the flipper arm in its pivoted position.

The power transmission according to the invention may have an electrically controllable parking brake (not shown) inserted between the motor and the flipper arm. E.g., a brake may be realized as a disc brake having discs of radial extension connected to the motor's power shaft or to the worm screw, or connected to the rotatable shaft. Spring biased brake blocks are controlled through electro-magnets to hold the discs in arrested position through frictional engagement until the magnets are energized to release the discs from engagement with the brake blocks, against the force of the springs. The electromagnets are activated upon supply of current for rotation of the flipper arm, and are non-activated for applying brake force to the discs upon cease of current supply. A hydraulically activated brake may be arranged in the power transmission between the motor and the flipper arm in an analogous way.

As preferred, the power transmission is arranged as illustrated to have an irreversible or self-locking worm drive wherein the pitch of threads in worm screw and gearwheel are chosen to prevent rotation of the worm screw 12 when a load is externally applied to the flipper arm. Irreversible reduction gears are known per se and are used in different connections, such as in vehicle steering, to prevent external forces from being transferred back through the power transmission and to apply load to the power supply system. In the subject application, the operation of the self-locking worm drive is used to unload the motor and to protect the motor from damaging forces, while simultaneously resulting in a reduction of motor effect and size which may be dimensioned to provide the reduced power that is required for pivoting of the flipper arm only. The self-locking worm drive of the illustrated embodiment may alternatively, as desired, be operated in combination with a parking brake. This may, e.g., be called for in order to counteract a play possibly occurring in the engagement between the gear-wheel and the worm screw.

The invention is defined through the characterizing features of the accompanying claims, the same being construed to encompass the embodiments illustrated above and any modification thereof that, from this description, is derivable by a person skilled in the art.

What is claimed is:

1. A device on a spreader comprising:

a flipper arm which is supported at a corner of the spreader such that the flipper arm is pivotable between an upraised rest position and a lowered operative position wherein the flipper arm is effective for positioning of the spreader corner relative to a corresponding corner of a container upon connecting the spreader to the container, wherein the flipper arm is carried on a rotatable shaft and driven by a motor; and a power transmission inserted between the motor and the flipper arm, the power transmission being effective for transferring torque from the motor to the flipper arm for pivoting the flipper arm upon energizing the motor, and the power transmission being operative for locking the flipper arm in either one of the upraised rest position or the lowered operative position upon de-energizing the motor;

wherein the power transmission between the motor and the flipper arm is a self-locking worm drive having a helical thread worm screw which is driven by the motor and engaging tangentially a gear-wheel carried on the rotatable shaft, and wherein a pitch of threads in the worm screw and the gear-wheel are chosen to permit the gear-wheel to be rotated by the worm screw while preventing the worm screw from being rotated by the gear-wheel.

2. The device of claim 1, wherein the motor is an electric motor.

3. The device of claim 1, further comprising:

a housing comprising the motor, the power transmission and the rotatable shaft, wherein the housing is mountable onto the spreader as a unit.

4. A device on a spreader comprising:

a flipper arm which is supported at a corner of the spreader such that the flipper arm is pivotable between an upraised rest position and a lowered operative position wherein the flipper arm is effective for positioning of the spreader corner relative to a corresponding corner of a container upon connecting the spreader to the container, wherein the flipper arm is carried on a rotatable shaft and driven by a motor;

a power transmission inserted between the motor and the flipper arm, the power transmission being effective for transferring torque from the motor to the flipper arm for pivoting the flipper arm upon energizing the motor, and the power transmission being operative for locking the flipper arm in either one of the upraised rest position or the lowered operative position upon de-energizing the motor;

a housing having a base plate arranged for mounting the housing onto a spreader, the rotatable shaft journalled in the housing for rotation and arranged for carrying the flipper arm in one end thereof, wherein at least one end of the rotatable shaft projects out of the housing;

a first gear-wheel carried on the rotatable shaft in concentric relation through a coupling that connects non-rotationally the first gear-wheel to the rotatable shaft;

a worm screw journalled for rotation in the housing base plate and in a top side of the housing, respectively, the worm screw having an external thread tangentially engaging the first gear-wheel; and a second gear-wheel non-rotationally carried on the worm screw, the second gear-wheel engaging a drive wheel carried on a power shaft of the motor which is mounted on the housing.

* * * * *